United States Patent [19]

Cody

[11] 4,102,096

[45] Jul. 25, 1978

[54] LEG BRACE ASSEMBLY FOR ADJUSTABLE SHORING APPARATUS

[75] Inventor: David L. Cody, Hoffman Estates, Ill.

[73] Assignee: Symons Corporation, Des Plaines, Ill.

[21] Appl. No.: 773,388

[22] Filed: Mar. 2, 1977

[51] Int. Cl.[2] ..... E04D 15/00

[52] U.S. Cl. ..... 52/122; 52/646; 248/354 P

[58] Field of Search ..... 52/651, 652, DIG. 11, 52/637, 638, 122, 645; 182/224, 225; 248/354 P, 354 R, 354 S, 357; 403/49

[56] References Cited

U.S. PATENT DOCUMENTS

| | | | |
|---|---|---|---|
| 2,114,902 | 4/1938 | Henderson | 52/692 |
| 3,643,907 | 2/1972 | Haw | 248/354 P X |
| 3,693,309 | 9/1972 | Kutchai | 248/354 S |
| 3,902,289 | 9/1975 | Dashew | 52/122 |

*Primary Examiner*—Ernest R. Purser
*Assistant Examiner*—Carl D. Friedman
*Attorney, Agent, or Firm*—Norman H. Gerlach

[57] ABSTRACT

A leg brace assembly is employed in combination with adjustable shoring apparatus, such apparatus including a truss-like structure, a vertically extending leg adapted to support the structure and being vertically reciprocally movable relative to the structure for adjusting the combined height thereof, and means for adjustably connecting the leg to the structure at a selected vertical position relative thereto, the leg brace assembly comprising an elongated leg brace member, means for connecting the leg brace member to the structure for swinging movement of the leg brace member about a transverse axis, and means for detachably connecting the leg brace member to the leg at a point spaced below the structure to thereby brace the leg against the structure, whereby the leg brace member may be disconnected from the leg and swung upwardly about said axis to a position wherein the leg brace member is disposed completely above the bottom surface of the structure.

11 Claims, 9 Drawing Figures

LEG BRACE ASSEMBLY FOR ADJUSTABLE SHORING APPARATUS

BACKGROUND OF THE INVENTION

This invention relates to a leg brace assembly for adjustable shoring apparatus. More particularly, the invention relates to a leg brace assembly for shoring apparatus which is adapted for supporting a concrete form and which may be employed in unitary concrete form installations or assemblies of the flying deck type.

Vertically adjustable shoring apparatus has become increasingly popular for use in supporting concrete floor slab formwork, owing to the relative ease and rapidity with which the apparatus can be set up and used, and thereafter removed from beneath the floor slab and transported to another pour site. Efficiency has been increased by providing relatively large assemblies of shoring apparatus, which may be in modular form. It is especially advantageous to employ concrete form installations of the flying deck type, which are combinations of shoring apparatus and deck forms designed for use in the construction of multi-story structures having typical slabs. Concrete form installation units are placed in side-by-side and end-to-end relation, to provide a continuous deck form, which serves as a base for a concrete pour. After the floor slab has hardened, the vertically adjustable shoring apparatus employed in the units is collapsed, permitting the units to be moved endwise or sidewise between the floors. The units are moved laterally from between the floors and transported or "flown" by means of a crane to the next adjacent upper floor level for reuse thereat. Examples of prior apparatus employed for the foregoing purposes include U.S. Pat. Nos. 3,902,289 and 3,977,536, and my copending application Ser. No. 746,314, filed Dec. 1, 1976 for "Adjustable Shoring Apparatus", which disclose adjustable shoring apparatus embodying truss-like structures.

Vertical adjustment of the prior shoring apparatus, such as represented by the foregoing patents and application, is accomplished by the provision of supporting legs which are adjustably connected to the supported structure for adjusting the combined height thereof. Owing to the tolerances involved in the construction, the legs may move out of vertical alignment, reducing their load-carrying capacity, and the supported structure may sway on the legs, with the resulting danger that the entire structure will collapse. U.S. Pat. No. 3,902,289 discloses the use of corner braces for adjusting the alignment of the supported structure and resisting swaying. This structure does not serve to brace individual legs, however. Also, the structure is braced from the floor, which requires that the braces be anchored to the floor, and that the floor be patched after the structure is moved.

SUMMARY OF THE INVENTION

An important object of the present invention is to provide structure for bracing the legs of adjustable shoring apparatus having vertically adjustable supporting legs for varying the overall height of the apparatus.

A more specific object is to provide a leg brace assembly for adjustable shoring apparatus, which apparatus includes a truss-like structure and vertically extending legs adjustably supporting the structure, the brace assembly being connected to the structure and to a leg for bracing the leg against the structure.

Another important object is to provide a leg brace assembly of the foregoing character and which is mounted on a truss-like structure and connected to a leg in such a manner that, when not serving to brace the leg, the leg brace assembly may be raised or retracted completely above the bottom of the truss-like structure, for the purpose of transporting the shoring apparatus on the bottom surfaces of the structure without interference from the leg brace assembly. An accompanying object is to provide a leg brace assembly which may be employed together with shoring apparatus in which the supporting legs similarly may be retracted into positions on the truss-like structure above its bottom surfaces, whereby in the course of transportation, the entire assembly of shoring apparatus and leg brace assembly may be moved on such bottom surfaces, as on rollers. At the same time, the assembly of shoring apparatus and leg brace assembly is placed in a compact form and without projecting supporting structure.

Another object is to provide a leg brace assembly of the foregoing character which is conveniently mounted on a supported structure and connected to a supporting leg, which may be mounted at various locations along the length of the supported structure, as correspond to the locations in which the leg may be mounted, and which is readily removed when not needed.

In the invention, a leg brace assembly is employed in combination with adjustable shoring apparatus, which shoring apparatus includes a truss-like structure, a vertically extending elongated leg associated with and extending below the structure to provide support therefor, the leg being vertically reciprocally movable relative to the structure for adjusting the combined height thereof, and means for adjustably connecting the leg to the structure at a selected vertical position relative thereto, the leg brace assembly comprising an elongated leg brace member, means for connecting the leg brace member to the structure for swinging movement of the leg brace member about an axis extending transversely of the structure, and means for detachably connecting the leg brace member to the leg at a point spaced below the structure to thereby brace the leg against the structure, whereby the leg brace member may be disconnected from the leg and swung upwardly about the axis to a position wherein the leg brace member is disposed completely above the bottom surface of the structure to permit movement of the shoring apparatus on such surface without interference from the leg brace member.

In a preferred construction according to the invention, a leg brace assembly for bracing legs connected to a pair of truss-like structures in spaced parallel relation comprises a pair of leg brace members, means for connecting the leg brace members to respective truss-like structures for swinging movement, means for detachably connecting the leg brace members to the legs, and a pair of cross brace members extending between and interconnecting the leg brace members in a rigid frame, whereby the frame may be disconnected from the legs and swung upwardly to a position wherein the frame is disposed completely above the bottom surfaces of the truss-like structure.

Other objects, advantages, and features of the invention will become apparent from the following description of preferred embodiments of the invention, taken in conjunction with the accompanying drawings.

BRIEF DESCRIPTION OF THE DRAWINGS

The attached drawings illustrate a preferred embodiment of the invention, without limitation thereto. In the drawings, like elements are identified by like reference numerals in each of the views, and.

DESCRIPTION OF THE PREFERRED EMBODIMENTS

Figure 1:
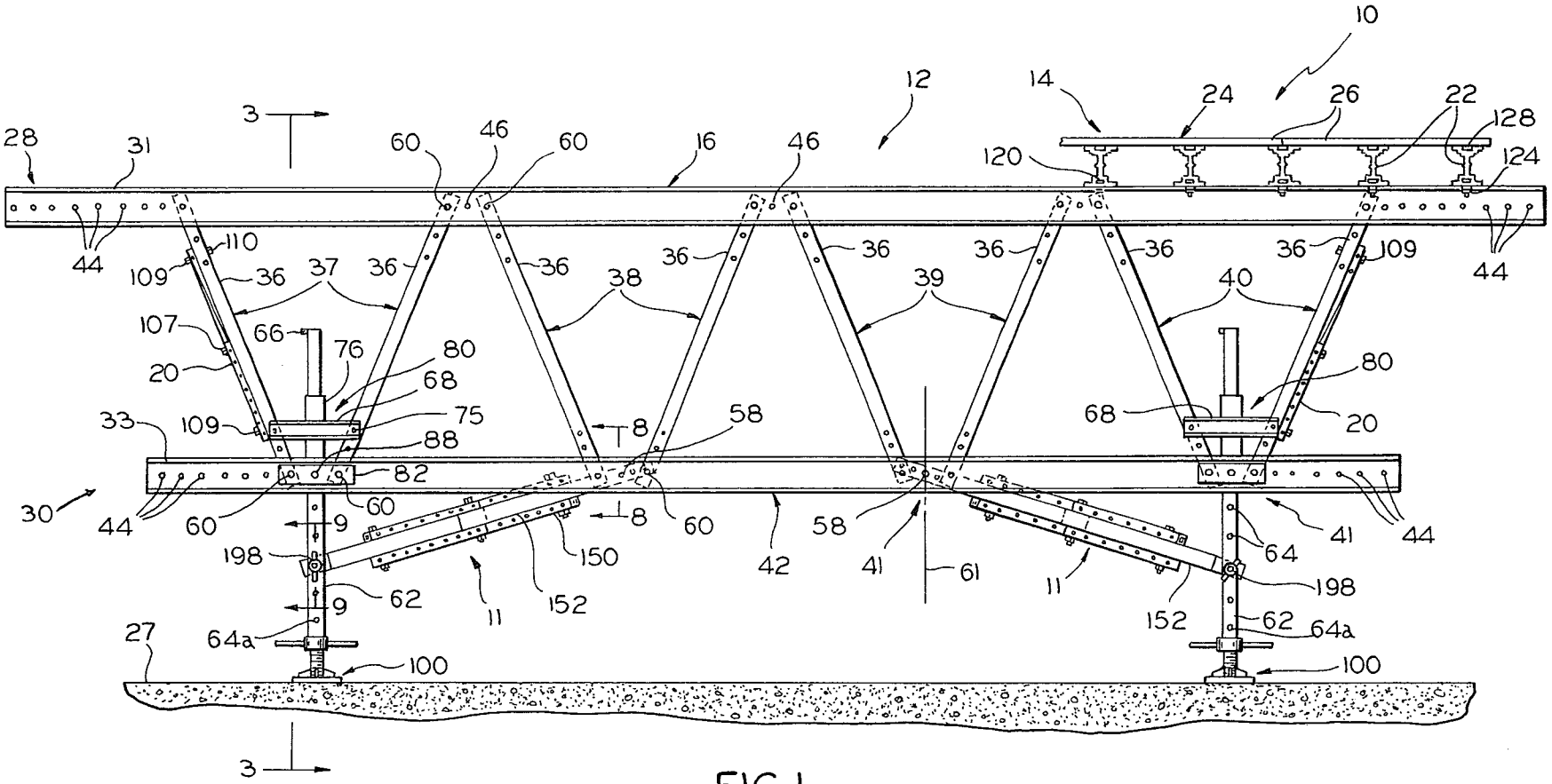
FIG. 1 is a side elevational view of a concrete form installation or assembly unit of the flying deck type, with but a portion of the form work thereof illustrated.
Figure 3:
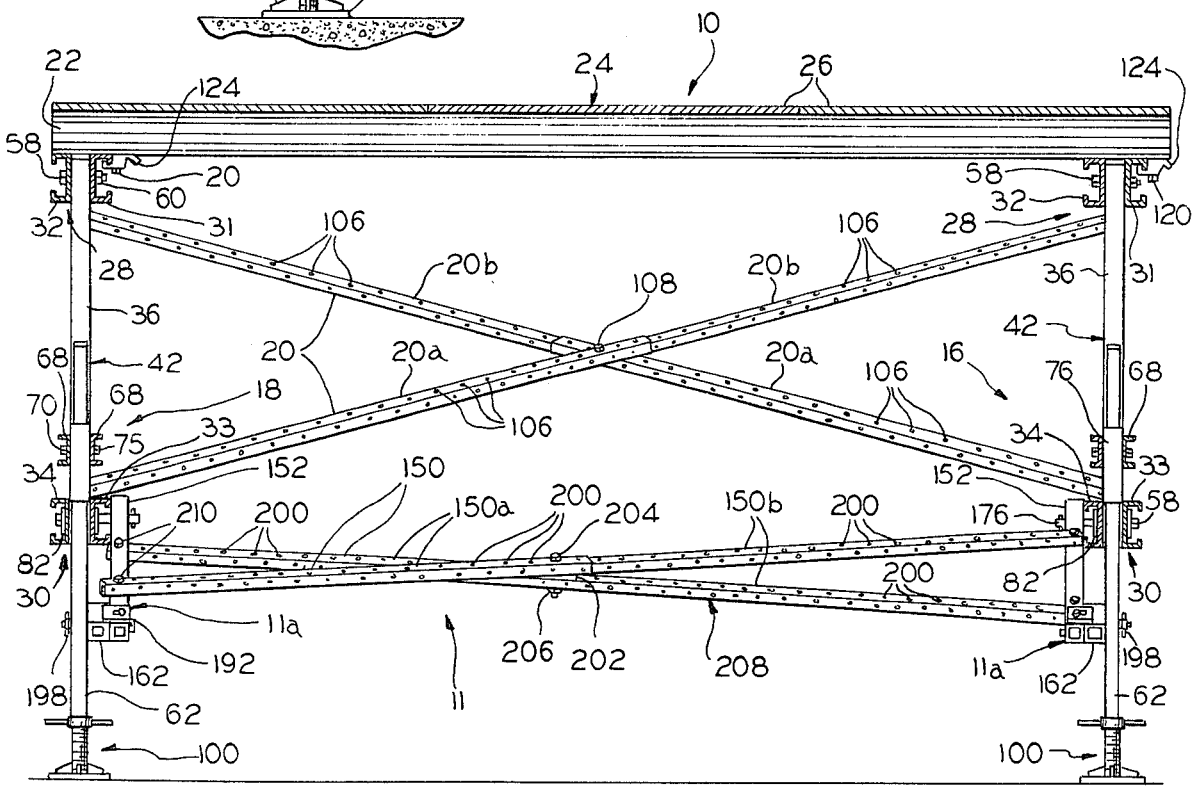
FIG. 3 is a transverse sectional view of the shoring assembly unit illustrated in FIG. 1, taken substantially on line 3—3 thereof and drawn to a slightly enlarged scale.

Referring to the drawings, FIGS. 1 and 3 illustrate a concrete form installation or assembly unit 10 of the flying deck type having leg brace assemblies 11 combined therewith in a preferred embodiment of the invention. The form installation unit 10 is described in my aforesaid copending application, to which reference is made for details not repeated herein. The unit 10 includes a shoring assembly unit 12 and a formwork unit 14 supported thereby. The shoring assembly unit 12 is a modular three-dimensional structure having as its principal components two like narrow, elongated shoring apparatus units 16 and 18. The shoring apparatus units 16 and 18 are rigidly secured together in spaced parallel transversely aligned relation by unit cross braces 20 at the opposite ends of the shoring assembly unit 12. The formwork unit 14 is constructed of a plurality of spaced parallel joist-like structural members 22, which are seated on and connected to the shoring assembly unit 12, and extend transversely thereof. The formwork unit 14 also includes a deck 24 formed of rows of plywood panels 26, which are secured to the structural members 22.

The form installation unit 10 is assembled for use on a foundation or floor slab 27. The form installation unit 10 may be employed alone or with additional units of like character adjacent thereto in end-to-end and side-by-side relation, according to the requirements of the concrete floor to be formed thereon. A continuous deck is made up of the panels 26 or the like, and concrete is poured thereon and allowed to harden. Thereafter, the form installation unit 10 is lowered or collapsed, and then removed for use in another location. The form installation unit 10, with the exception of certain screw jacks thereof, and the leg brace assemblies 11 are adapted to be transported completely, as a unit, both on a supporting surface and from one elevation to another. In particular, crane cables may be secured to the form installation unit 10, and the unit may be moved by means of a crane from one floor to another during the construction of a multi-story building. The shoring assembly unit 12 and the leg brace assemblies 11 may be transported together and without the formwork unit 14 thereon, in similar fashion.

The shoring apparatus units 16 and 18 also are adapted for individual use, without being interconnected. In such case, a sub-assembly 11*a* (FIGS. 4 and 7) of the leg brace assembly 11 may be employed in combination with each apparatus unit 16 and 18, as described hereinafter. An example of individual use is where one of the units 16 and 18 is employed for the support of a concrete beam form. The shoring apparatus units 16 and 18 having the leg brace subassemblies 11*a* mounted thereon are capable of movement on a supporting surface and of being moved by a crane in similar fashion to the form installation unit 10 and the shoring assembly unit 12 having the leg brace assembly 11 thereon.

Referring to FIGS. 1–4, the shoring apparatus unit 16, representative of both units 16 and 18, is constructed of an upper pair 28 and a lower pair 30 of spaced apart parallel channel-shaped chords 31,32 and 33,34, respectively, having horizontally extending longitudinal axes. Rectangular tubular struts or web members 36, which have square cross sections in the illustrative embodiment, extend obliquely from the upper chord pair 28 to the lower chord pair 30 and between the chords in each pair, in a continuous longitudinal series of four strut pairs 37–40 (FIG. 1) of like substantially V-shaped configuration having their apices 41 at the lower chord pair 30. The respective upper and lower ends of the struts 36 are connected to the chords 31,32 and 33,34 of the upper and lower pairs 28 and 30, respectively, in a truss-like structure 42 by means subsequently described, which structure is adapted for supporting a load on the chords 31,32 of the upper pair 28.

The chords 31–34 are structurally identical, differing only in length in the illustrative embodiment, and may be used as upper or lower chords, as required. Referring to the lower chord 33 illustrated in FIGS. 1 and 4 as representative, the chord includes upper and lower flanges 33*a* and 33*b* extending horizontally outwardly at right angles from a vertically extending integral web 33*c*. The web 33*c* is provided with a group of nine equidistantly spaced bolt holes 44 in an axial row adjacent to each of the opposite ends of the chord 33. At equidistantly spaced intervals along the chord 33, intermediate groups of three equidistantly spaced bolt holes 46 (FIG. 8) are provided in the web 33*c*, and they have the same spacing as the bolt holes 44 in the end groups. There are three of such intermediate groups of bolt holes 46 in the upper chords 31 and 32, and two of such intermediate groups in the lower chords 33 and 34. The bolt holes 44 and 46 in each chord of a pair are in transverse register or alignment with the corresponding holes of the remaining chord of the pair. As seen in FIG. 1, the upper chord pair 28 extends outwardly beyond the lower chord pair 30 at both ends thereof, and the groups of bolt holes 44 and 46 in the upper chord pair 28 are in longitudinally offset or staggered relation to the groups of bolt holes 44 and 46 in the lower chord pair 30.

The chords 31–34 and the struts 36 are connected together in the truss-like structure 42 by connecting bolts 58 (FIG. 3) and connecting nuts 60 threaded thereon. The bolts 58 are inserted through the bolt holes 44 or 46 in the chords 31–34 and registering bolt holes in the ends of the struts 36, and are secured with the nuts 60. The ends of the struts 36 are connected to the chords at alternate bolt holes 44 or 46, with the ends of two struts adjoining and spaced apart with one bolt hole left therebetween at each group of bolt holes in each chord pair, except where the end struts terminate at the upper chord pair 28. The axes of the bolt holes 44 and 46 between the adjoining strut ends may be referred to as the "panel points" of the truss-like structure 42. Such panel points are uniformly or equidistantly spaced apart the same distance along each chord pair 28 and 30, and the panel points of each chord pair are in longitudinally offset relation to those of the other chord pair by a distance equal to one-half the distance between panel points. The vertical center lines 61 (FIG. 2) of the successive strut pairs 37–40 intersect the panel points of the lower chord pair 30, and likewise are uniformly spaced apart for a distance equal to the distance between panel points. The chords 31,32 in the upper pair 28 extend longitudinally outwardly beyond the chords 33,34 in the lower pair 30 at opposite ends of the structure 42 for a distance equal to one-half the distance between the center lines 61 of successive strut pairs 37–40.

Each of the shoring apparatus units 16 and 18 includes a plurality of elongated tubular legs 62 of rectangular cross section, being square in the illustrative embodiment, which extend vertically in the unit. In the illustrative embodiment, there are two such legs in each of the shoring apparatus units 16 and 18, and four legs in the shoring assembly unit 12. Each of the legs 62 has a vertical series of support pin holes 64, there being eight such holes in the illustrative embodiment, including a lower hole **64*a* adjacent the bottom of the leg. The support pin holes 64 extend through each leg 62 and between the opposite laterally facing sides thereof. The support pin holes 64 are spaced equidistantly along the length of each leg 62, except for the lower hole 64*a* and the next adjacent hole 64, which are closer together. At the top of each leg 62, on one of the longitudinally facing sides thereof, a stop block 66** is welded to the leg.

The upper portion of each leg 62 is inserted between the chords 33 and 34 in the lower pair 30 in each of the shoring apparatus units 16 and 18. Each leg also is inserted between the struts 36 in a selected one of the strut pairs 37–40 at the apex 41 thereof, there being provided suitable spacing between the lower ends of the struts in each pair for that purpose. In the illustrative embodiment, legs 62 are inserted between the struts 36 of the end strut pairs 37 and 40, which are the first and fourth strut pairs, of each truss-like structure 42. The lower portion of each leg 62 in functional position extends below the structure 42 to provide support therefor. The legs 62 are vertically reciprocally movable relative to the structure 42, for adjusting the combined or overall height of the structure and the legs.

A pair of spaced parallel horizontal strut cross braces 68 in the form of channel bars interconnects the struts 36 in each of the first and fourth strut pairs 37 and 40, having legs 62 inserted therebetween. The cross braces 68 are connected at points on opposite sides of the struts 36 and spaced from the upper and lower chord pairs 28 and 30, by means of bolts 70 inserted through holes in the webs of the cross braces and through holes in the struts adjacent to the lower ends of the struts, and secured by nuts 75. A vertical leg guide member 76 in the form of a rectangular tube is fixedly mounted on the cross braces 68 therebetween, such as by welding, thereby providing a leg guide assembly 80. The leg guide member 76 in the illustrative embodiment has a square cross section, and closely receives the leg 62 inserted between the interconnected struts 36 for guided vertical sliding relative movement therein. The stop block 66 prevents the leg 62 from falling out of the guide member 76.

The leg guide assembly 80 is readily and rapidly connected to and disconnected from any of the strut pairs 37–40 selected for insertion of a leg 62 between the struts thereof. It need not be employed with the remaining strut pairs. The leg guide assembly 80 functions both to maintain a leg 62 in proper vertical alignment and to brace the struts 36 connected thereto and thereby increase their lateral stability under load, but the leg guide assembly 80 carries no vertical load.

The support pin holes 64 of each leg 62 register successively with the bolt holes 44 in the lower chords 33 and 34, at the center lines 61 of the first and fourth strut pairs 37 and 40, as the leg is raised and lowered. The truss-like structure 42 may be supported on the legs 62 at a selected elevation, by inserting a support pin or the like through the latter bolt holes 44 and through a selected one of the support pin holes 64 in each leg. In the preferred construction, however, a relatively lightweight material is employed for fabricating the chords 31–34, such as an aluminum alloy. In view of the concentration of load stresses at the junctures of the lower chords 33 and 34 with the struts 36 and with the legs 62, it is preferred to employ load transfer members 82, which are in the form of rectangular plates, to transfer the load from the struts 36 to the legs 62. The load transfer members 82 and the legs 62 preferably are constructed of material having relatively high structural strength, and in the preferred embodiment, are constructed of steel. The struts 36, the cross braces 68, and the leg guide member 76, like the chords 31–34, preferably are constructed of extruded aluminum alloy, and together with the load transfer members 82 and the legs 62 provide a relatively lightweight structure having the requisite strength and rigidity.

The load transfer members 82 are employed in pairs connected to the first and fourth strut pairs 37 and 40, or other selected strut pairs, between which the legs 62 are inserted. One member 82 is disposed adjacent to each of the webs **33*c* and 34*c* of the lower chords, on the outer side thereof. Each member is provided with three bolt holes aligned in an axial row and spaced apart between centers the same distance as the spacing of the bolt holes 44 and 46 in the chords 31–34. Two bolt holes adjacent to opposite ends of each member have the same diameters as the bolt holes 44 and 46, and receive bolts 58 therethrough. The bolts 58 which are inserted through the transfer members 82 also serve to connect a pair of struts 36 to the chords 33 and 34, as described above, and, consequently, transfer the load forces from the truss-like structure 42 to the load transfer members 82**.

A support pin 88 is received in the central hole of each load transfer member 82, and the pin also extends through registering chord bolt holes 44 at a center line 61 and a registering support pin hole 64 in a leg 62. The hole in each transfer member 82 which receives the support pin 88 is of smaller diameter than the registering chord bolt holes 44. Consequently, the load forces are transferred from the load transfer members 82 to the leg 62 via the support pin 88, while the registering bolt holes 44 merely provide larger openings through the chords, with clearance on all sides to allow free passage of the support pin 88 therethrough. Each truss-like structure 42 is vertically adjustably supported on the leg 62 at selected elevation in the foregoing manner.

The legs 62 also are movable into out-of-the-way or retracted positions on each truss-like structure 42, in which positions the support pin holes 64*a* adjacent to the bottoms of the legs lie between the upper and lower margins of the chords 33 and 34 of the lower pair 30. That is, the lower edge of each leg 62 is elevated at least as far as the bottom surfaces of the lower flanges 33*b* and 34*b* of the lower chord pair, and preferably to locations above such flange surfaces, so that there is no obstruction to rolling the structure 42 on such flanges. The legs are raised for this purpose until the support pins 88 may be inserted through the load transfer members 82 and the lower support pin holes 64*a* in the legs, to support the legs on the structure 42. The structure 42 then may be transported with the legs 62 carried thereby, and in the course of transportation, it may be moved on rollers which rollably engage the lower flanges 33*b* and 34*b* of the lower chord pair 30 without interference from the legs. The length of the legs 62 preferably is selected so that the upper edge or extremity of each leg lies between the upper and lower surfaces of the upper chords 31 and 32 at this time. The legs 62 then do not encounter interference with the formwork supported on the upper chords, such as the illustrative formwork unit 14 or other formwork.

Figure 2:
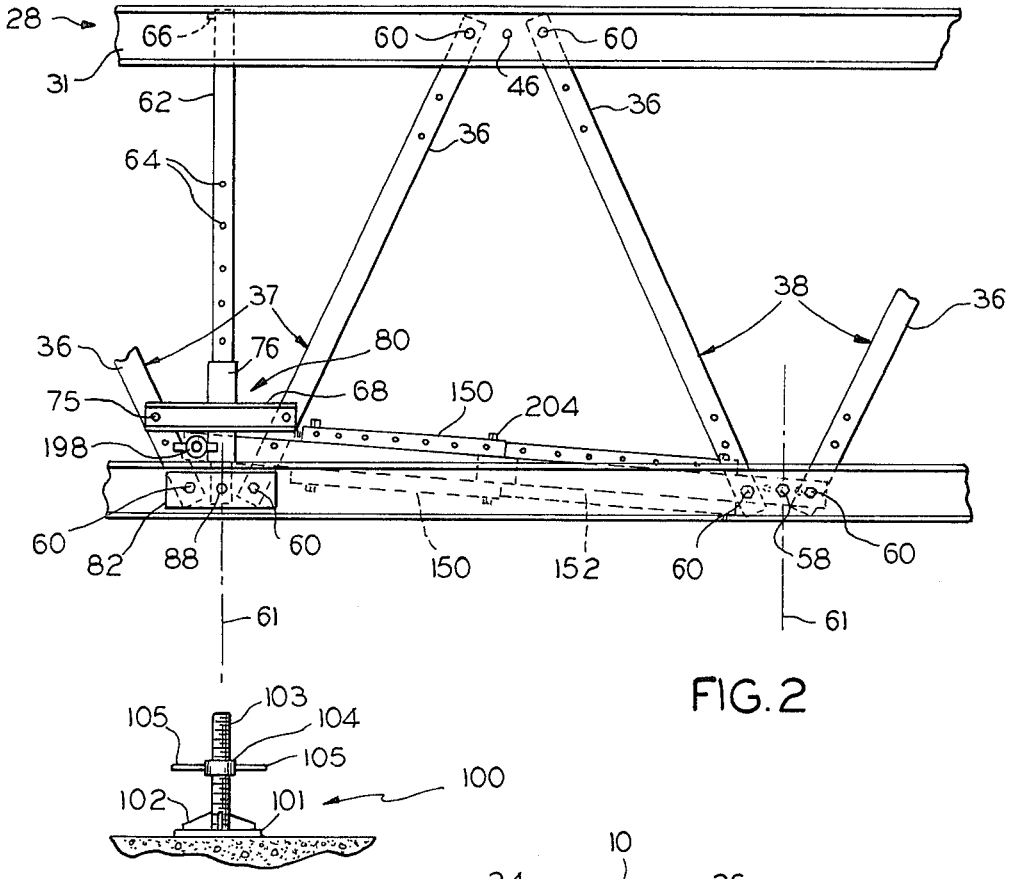
FIG. 2 is an enlarged fragmentary side elevational view of a shoring assembly unit constituting part of the form installation unit of FIG. 1, illustrating raised, out-of-the-way positions for legs and a leg brace assembly thereof.

A screw jack 100 is provided for engagement with and support of each of the legs 62 in the illustrative embodiment. Referring to FIG. 2, the jack 100 includes a base plate 101, four upstanding gussets 102 welded thereto at 90 degree angles therearound, and a screw 103 extending vertically from the center of the base plate and welded thereto and to the gussets. The jack also includes an internally threaded cylindrical nut 104 in threaded engagement with the screw 103, and a pair of handles 105 welded to and extending diametrically outwardly from opposite sides of the nut, for rotation of the nut thereby. The upper end of the screw 103 is received within the lower end of a tubular leg 62, while the lower edges of the leg seat on the nut 104. The jacks 100 provide fine adjustment of the overall height of the shoring assembly unit 12, whereas the legs 62 provide for coarse adjustment thereof. The legs 62 and the jacks 100 provide like adjustment of the height of the individual shoring apparatus units 16 and 18 when employed separately. When the shoring assembly unit 12 is transported from place to place, the jacks 100 may be carried in a suitable receptacle supported on the unit.

Referring to FIG. 3, the unit cross braces 20 which join the individual shoring apparatus units 16 and 18 together are constructed of telescoping outer and inner rectangular tubular sections 20*a* and 20*b*, respectively, each of which has a row of holes 106 therethrough. The cross braces are joined together in X-fashion by means of a bolt 107 (FIG. 1) which extends through registering holes 106 in the cross braces at their intersection and is secured by a nut 108 (FIG. 3). The ends of the cross braces 20 are secured to struts 36 in the shoring apparatus units 16 and 18. In the illustrative embodiment, the cross braces are secured to the end struts 36, which are the outer struts in the end strut pairs 37 and 40. Bolts 109 (FIG. 1) are inserted through the holes 106 in the cross braces 20 and through bolt holes adjacent opposite ends of the struts 36, annd the bolts 109 are secured by nuts 110.

Referring to FIGS. 1 and 3, the form installation unit 10 is completed by connecting the structural members 22 to the upper chord pairs 28, and connecting the deck panels 26 to the structural members 22. The structural members 22 are connected to the upper chord pairs 28 by means of attachment clips 124 which engage the chord flanges, and clamping nut and bolt combinations 120 which engage the clips 124 and the structural members 22. The deck panels 26 are nailed to wooden strips 128 which are secured in the structural members 22 and exposed at their upper surfaces. The connecting structure is claimed in my copending U.S. patent application Ser. No. 658,515, filed in Feb. 17, 1976. In the foregoing manner, the components of the form installation unit 10 are securely fastened together and may be transported safely on rollers and by crane.

The truss-like structures 42 and the shoring assembly unit 12 may be constructed in various lengths, employing chords of suitable lengths. The legs 62 may be inserted between the struts of any strut pair, such as the strut pairs 37–40, to provide optimum support for a load. The height of the truss-like structures 42 may be varied, employing struts 36 of different lengths for that purpose, and the length of the legs 62 may be varied. One or more modular shoring assembly units, such as the unit 12, may be employed, with the units joined end-to-end where more than one assembly is employed. The units may be of the same or different lengths, and the positions of the legs 62 may be adjusted for distributing the load on the combined units. Similarly, individual shoring apparatus units, such as the units 16 and 18, may be connected in end-to-end relation, for use in situations where an assembly of two parallel shoring apparatus units is not required.

The leg brace assembly 11 may be mounted on the shoring assembly unit 12 for bracing a pair of legs 62 at any location in the unit. Two leg brace assemblies 11 are employed for bracing the four legs 62 in the illustrative structure. Each leg brace assembly 11 includes two leg brace sub-assemblies 11*a* on opposite sides thereof and in generally parallel relation, and a pair of cross brace members 150 extending transversely therebetween.

Referring to FIGS. 5–9, each leg brace sub-assembly 11*a* includes an elongated tubular leg brace member 152 of square cross section in the illustrative embodiment. The leg brace member 152 is provided with a longitudinal series of pivot pin holes 154 extending through opposite walls thereof adjacent one end 152*a* of the brace member. The holes 154 are spaced apart for increasing distances in the direction of the adjacent end 152*a*, for reasons which will appear. A connecting pin hole 156 extends through the opposite walls of the brace member 152 adjacent to the remaining end 152*b* thereof, in parallel relation to the pivot pin holes 154. Spaced apart bolt holes 158 and 160 extend through the remaining walls of the brace member 152, adjacent to the respective ends 152*a* and 152*b*.

A spacer 162 is mounted on the brace member 152, adjacent to the connecting pin hole 156. The spacer is provided with a connecting pin hole 164 which extends through opposite walls thereof, and is arranged for alignment with the connecting pin hole 156 in the brace member 152. Rectangular attachment plates 166 are secured to the spacer 162 on opposite sides thereof, as by welding, and they extend over the walls of the brace member 152 which have the bolt holes 158 and 160 therein. A mounting slot 168 is provided in each attachment plate 166, and it extends laterally with respect to the spacer 162. A mounting bolt 170 extends through each mounting slot 168 and through the adjacent wall of the brace member 152, and is secured by an external nut 172 which extends beyond the edges of the mounting slot. In this manner, the spacer 162 is mounted on the brace member 152 for swinging movement between positions on opposite sides thereof, as illustrated in full and phantom lines in FIGS. 5 and 6.

Figure 8:
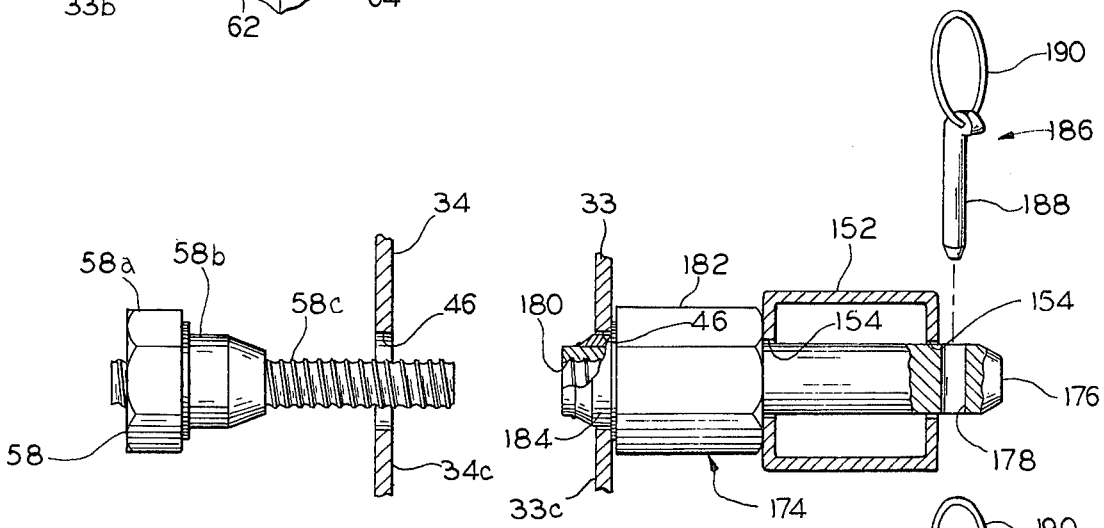
FIGS. 8 and 9 are enlarged detail sectional views of components of the leg brace assembly, taken substantially on lines 8—8 and 9—9, respectively, of FIG. 1.

Each leg brace sub-assembly 11*a* includes means for connecting the leg brace member 152 thereof to a truss-like structure 42 for swinging movement about an axis extending transversely of the structure. Referring to FIG. 8, such means includes a pin assembly 174 and a connecting bolt 58, which are mounted on the webs 33*c* and 34*c*, and between the flanges 33*a*,33*b* and 34*a*,34*b* of the chords 33 and 34 in the lower pair 30. The pin assembly 174 includes a substantially cylindrical pivot or hinge pin 176 having a transverse fastener-receiving hole 178 extending therethrough adjacent one end thereof and a longitudinal threaded socket 180 formed in the opposite end thereof. A hexagonal spacer sleeve 182 is secured on the pivot pin 176 around the socket end thereof, by suitable means such as welding. The sleeve 182 includes an outer cylindrical bearing shank 184 of reduced diameter slightly less than the diameter of a chord bolt hole 46. A conventional clip fastener 186 includes a finger 188 insertable in the transverse hole 178 in the pivot pin 176, and a ring 190 pivotally attached to the finger and swung down over the end of the pivot pin 176 in use. The connecting bolt 58 in the sub-assembly 11*a*, like other bolts identified by the same number in the shoring apparatus units 16 and 18, includes a hexagonal head 58*a*, a generally cylindrical bearing shank 58*b*, and a threaded stem 58*c* of reduced diameter with respect to the shank, which is inserted in a threaded bore in the head 58*a* and the shank 58*b* and secured therein in a suitable manner, such as by welding. The diameter of the bolt shank 58*b* is slightly less than the diameter of a chord bolt hole 46.

The pin assembly 174 and the connecting bolt 58 are mounted on the chords 33 and 34 by inserting the shank 184 of the spacer sleeve 182 in a chord bolt hole 46, and inserting the bolt stem 58*c* through a registering bolt hole 46 in the adjacent chord, into threaded engagement in the pin socket 180 and with the bolt shank 58*b* received in the registering hole 46. The leg brace member 152 is mounted for swinging movement on the pivot pin 176 by inserting the pivot pin through a selected one of the pivot pin holes 154 in the leg brace member, after which the finger 188 of the fastener 186 is inserted in the fastener-receiving hole 178 in the pivot pin, for retaining the leg brace member on the pivot pin. The fastener 186 is secured in place by swinging its ring 190 down over the adjacent end of the pivot pin 176.

Figures 4, 5, 6:
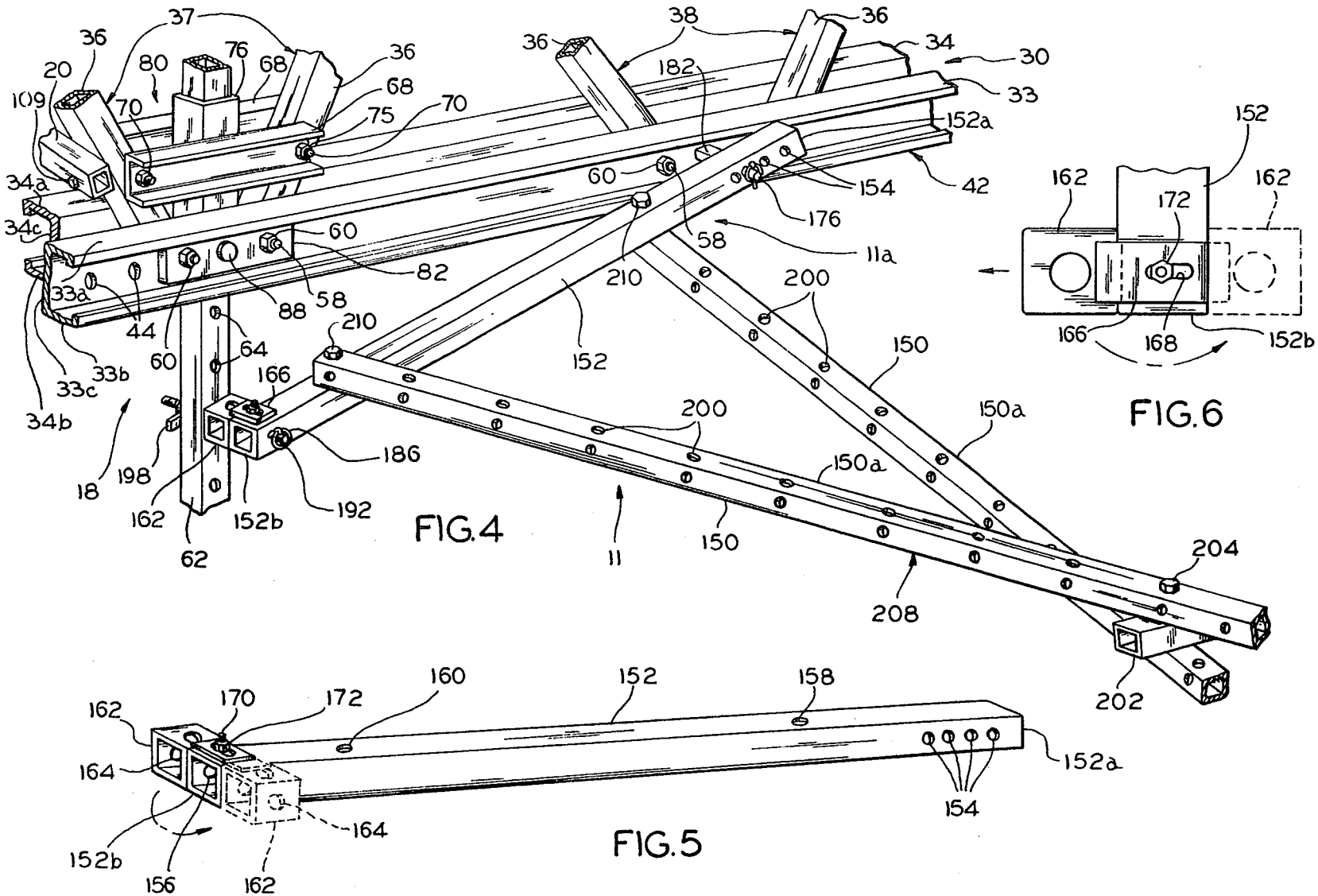
FIG. 4 is a further enlarged fragmentary perspective view of a shoring apparatus unit and a leg brace assembly as employed in the structures shown in the preceding views.
FIG. 5 is a still further enlarged perspective view of a leg brace member and a spacer associated therewith, as employed in the leg brace assemblies of the preceding views.
FIG. 6 is a further enlarged fragmentary top plan view of the structure illustrated in FIG. 5.
Figure 7:
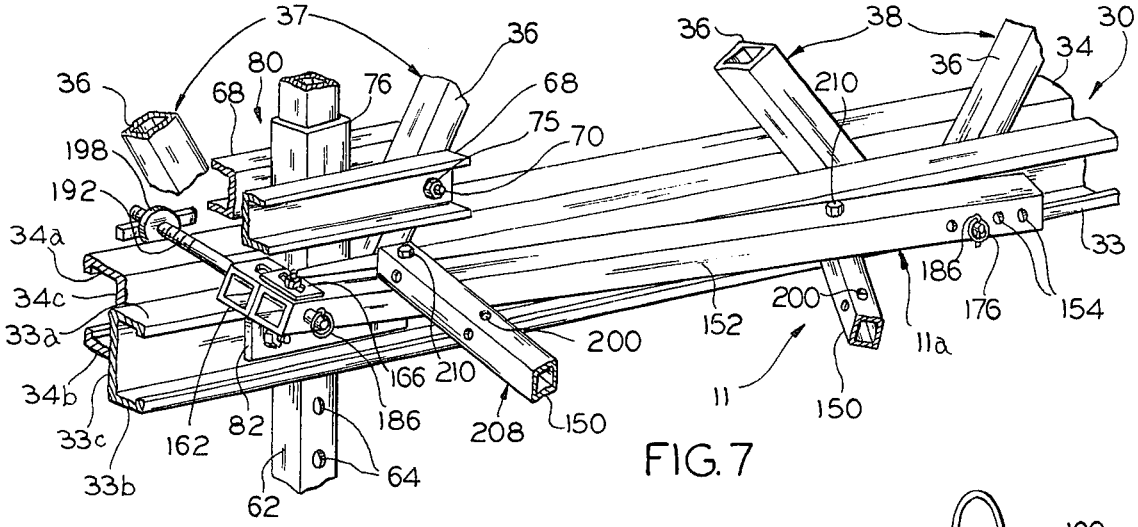
FIG. 7 is a fragmentary perspective view similar to FIG. 4 and with parts broken away, illustrating a raised position of the leg brace assembly.

As seen in FIGS. 4 and 7, the pivot pin 176 is mounted on the lower chords 33 and 34 of a truss-like structure 42 by securing the pin assembly 176 and a connecting bolt 58 in a pair of chord bolt holes 46 at the second strut pair 38, adjacent to the first strut pair 37, having a leg 62 inserted between the struts 36 thereof. The chord bolt holes 46 employed for mounting are those holes which register with the center line 61 for the second strut pair 38 and which are disposed between the lower ends of the struts 36 in the second strut pair. The support pin holes 64 in the leg 62 to be braced are aligned for registry with like chord bolt holes 46 between the struts 36 of the adjacent first strut pair 36. Another pin assembly 174 and another connecting bolt 58 are in like manner secured in chord bolt holes 46 between the struts 36 of the third strut pair 39, adjacent to the fourth strut pair 40, having a leg 62 inserted thereat, as seen in FIG. 1.

Each leg brace member 152 when in bracing position extends angularly downwardly from a lower chord pair 30 to the leg 62 to be braced. The disposition of the pivot pin 176 between the lower chord pair 30 of the truss-like structure 42 and the leg brace member 152 is suitably adjusted, by insertion in the proper one of the pivot pin holes 154, for aligning the connecting pin hole 156 in the leg brace member 152 with a selected one of the leg pin holes 64, at a point spaced below the structure 42. The brace spacer 162 is positioned between the brace member 152 and the leg 62, with the connecting pin hole 164 in the spacer registering with the connecting pin hole 156 in the leg brace member and with the selected leg pin hole 64.

Figure 9:
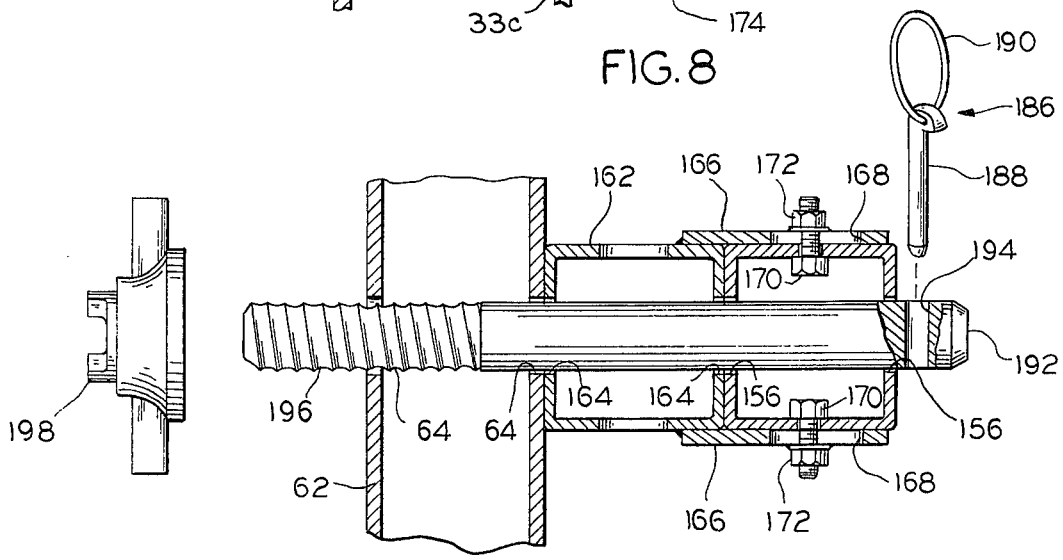

Referring to FIG. 9, means for connecting the leg brace member 152 to the leg 62 include a connecting pin 192 inserted through the registering pin holes 64, 164 and 156. The connecting pin 192 is generally cylindrical, and it is provided with a transverse fastener-receiving hole 194 adjacent to one end and a threaded stem 196 adjacent to the opposite end thereof. A clip fastener 186, having the structure previously described, serves to secure the connecting pin at one end, by insertion of its finger 188 in the fastener-receiving hole 194. The opposite end of the connecting pin 192 is secured by a hand-turned nut 198, which is received on the stem 196 in threaded engagement therewith.

in the foregoing manner, each leg brace sub-assembly 11*a* is connected to a truss-like structure 42 in one of the shoring apparatus units 16 and 18, for swinging movement of the leg brace member 152 thereof about an axis extending transversely of the structure. The leg brace member 152 is detachably connected to a leg 62 at a point spaced below the structure 42, to thereby brace the leg against the structure. The legs 62 are braced principally against sway or deviation from vertical positions in the longitudinal directions of the respective structures 42. The leg brace member 152 of each sub-assembly 11*a* may be disconnected from the leg 62, by removing the fastener 186 and/or the hand nut 198 from the connecting pin 192, and swung upwardly on the pivot pin 176, to a position wherein the brace member 152 is disposed completely above the bottom surface of the structure 42, represented by the bottom surfaces of the lower chord flanges 33*b* and 34*b*.

Referring to FIG. 3, the cross brace members 150, which extend between the leg brace members 152, are constructed of telescoping outer and inner rectangular tubular sections 150*a* and 150*b*, respectively, each of which has a row of holes 200 therethrough. Referring also to FIG. 4, a spacer bar 202 of the same transverse dimensions as a leg brace member 152 is interposed between the cross brace members 150 where they intersect. The cross brace members 150 are joined together at their intersection by means of a bolt 204 which is inserted through a hole 200 in each of the cross brace sections 150*a* and 150*b* and through a registering hole in the spacer bar 202, and secured by a nut 206. The ends of the cross brace members 150 are secured to the leg brace members 152 in a rigid frame 208 by bolt and nut combinations 210 the bolts of which extend through holes 200 in the cross brace member sections 150*a* and 150*b* and through registering bolt holes 158 and 160 (FIG. 5) in the leg brace members. One cross brace member 150 is fastened on top of the leg brace members 152, and the other cross brace member 150 is fastened on the bottom of the leg brace members 152, so that no twist is imparted to the frame 208. The width of the frame 208 is adjustable by virtue of the telescoping cross brace member sections 150*a* and 150*b*, to accommodate varying spacings between the shoring apparatus units 16 and 18.

The frame 208 serves to brace the legs 62 both longitudinally and laterally of the structures 42, so that the shoring assembly unit 12 is relatively rigid and secured against side sway in any direction. The frame 208, like the individual leg brace members 152 thereof, may be swung upwardly on the pivot pins 176, the axes of which substantially coincide.

In general, it is preferred to connect each leg brace member 152 to the third support pin hole 64 from the bottom of the leg braced thereby, as illustrated in FIG. 1, although the procedure may be varied. As the position of the leg 62 is adjusted upwardly or downwardly with respect to a structure 42, the point on the leg at which each leg brace member 152 is connected moves with respect to the structure 42 in the same manner. The disposition of the pivot pin 176 with respect to the leg brace member 152 is adjusted as the leg position is adjusted, by insertion in various ones of the pivot pin holes 154, to accommodate the varying distances between the selected leg hole 62 and the pivot pin. The four pivot pin holes 154 provide for four adjustments in elevation.

It will be apparent that, alternatively, other adjustment means may be employed; for example, provision may be made for mounting the pivot pin 176 on the lower chord pair 30 in alternate positions, or the brace member 152 may be made adjustable in length. The illustrative structure is preferred, however, as minimizing the number of parts while providing for simple and reliable assembly in a standardized manner. It is a feature of the preferred structure that the pivot pins 176 for their mounting make use of the chord bolt holes 46 which are provided to accommodate alternative leg mountings.

Referring to FIGS. 4–6 and 9, the frame 208 may be disconnected from the legs 62 conveniently by loosening the hand nuts 198 and removing the fasteners 186, after which the connecting pins 192 may be removed. Each brace spacer 162 is swung around the adjacent end of the leg brace member 152, to place the spacer in an out-of-the-way position on the opposite side of the brace member, such as illustrated for one spacer in broken lines in FIGS. 5 and 6. The spacer sleeve 182 around the pivot pin 176 spaces the leg brace member 152 from the adjacent chord 33, so that with the spacer 162 out of the way, the leg brace member may be swung upwardly without interference from the adjacent chord. The leg brace sub-assembly 11*a* as employed on the side of the frame 208 opposite to that illustrated in FIG. 4 faces in the opposite direction, and otherwise, it functions in the same manner.

After raising the frame 208 to the position illustrated in FIG. 7, the brace spacers 162 on opposite sides of the frame may be restored to their positions on the outside of the frame, in which positions they serve as rests supporting the frame in the elevated position. For this purpose, the spacers 162 are seated on the upper flanges 33*a* and 34*a* of the adjacent lower chords 33 and 34, respectively. Additional support and security in transit may be provided by replacing the connecting pins 192, the fasteners 186, and the hand nuts 198, inserting the connecting pins through adjacent openings in the respective structures 42, and securing the nuts 198 on the outside of the structures 42, as illustrated in FIGS. 2 and 7. In case the connecting pins 192 are not aligned with openings in the structures 42, the connecting pin assemblies may be stowed in another manner. Alternatively, other means may be employed for securing the frame 208 in the raised position.

In the raised position, the brace frame 208 and its components are disposed completely above the bottom surfaces of the chords 33 and 34 in the lower pairs 30, as illustrated in FIG. 2, to permit movement of the installation 10 on such surfaces without interference from the frame. With the legs 62 in their out-of-the-way or retracted positions on the structures 42, as illustrated in FIG. 2 and previously described, the installation 10 is ready to be moved. It may be moved on rollers or on dollies, with the chords 33 and 34 of the lower pair 30 supported thereon. The installation may be connected to crane cables and moved from one elevation to another.

As an example of a method of operation, and commencing with the form installation unit 10 and the brace assemblies 11 assembled as illustrated in FIGS. 1 and 2 and bearing a hardened concrete floor or slab which has been poured on top of the deck 24, the assembly is lowered to break the bond between the concrete and the deck, by turning the handles 105 to lower the nuts 104 on the jacks 100. The weight of the apparatus, except for the jacks 100, is transferred to fork lift trucks or the like, which may engage the bottom surfaces of the lower chord pair 30. The leg brace assemblies 11 are disconnected from the legs 62, by removing the assemblies of connecting pin 192, fastener 186, and hand nut 198. After swinging the brace spacers 162 towards the inside of the brace frames 208, the frames are swung upwardly to the position illustrated in FIG. 7, whereupon the brace spacers 162 are swung to the outside of the frame 208 and seated on the adjacent chords 33 and 34. The frame is locked in place by securing a connecting pin 192 to each brace member 152 and to a structure 42, in the manner illustrated in FIG. 7. The leg support pins 88 are removed, and the legs are raised to the position illustrated in FIG. 2. The support pins 88 then are reinserted in the load transfer members 82 and are inserted through the bottom hole 64*a* in each leg, to retain the legs in the retracted positions within the confines of the structures 42. The jacks are collected for appropriate transfer to the next pour site.

The form installation unit 10 carrying the leg brace assemblies 11 may be lowered onto dollies or rollers for movement thereon across the floor slab 27. Where the apparatus is to be flown to a higher elevation, it may be moved to the side of a building, where crane cables are attached. After transporting the apparatus to the next site, the procedure is, in general, reversed. Major height adjustments are made by vertically adjusting the legs 62 relative to the structure 42. Minor adjustments are made by operation of the jacks 100. In the event that there is a substantial change in the height requirement from one site to another, so that the leg support pins 88 are inserted through different ones of the leg holes 64, a corresponding adjustment is made in the pivotal mounting of the frames 208, by insertion of the pivot pins 176 in other pin holes 154 in the leg brace members 152.

Should it be desired to employ a single shoring apparatus 16 or 18 alone, the cross brace members 150 may be disconnected from the leg brace members 152. The remaining leg brace sub-assemblies 11*a* continue to function in the same manner, but without the lateral bracing afforded by the connections to the cross brace members 150.

While the invention has been illustrated as applied to a preferred structure such as disclosed in my aforesaid copending application Ser. No. 746,314, the leg brace assembly in its broader aspects may be combined with other shoring assembly units, such as illustrated in the afore-mentioned U.S. Pat. Nos. 3,902,289 and 3,977,536. It will be apparent that when such other units are braced, modifications may be made in the assembly unit and/or in the specific form of the brace assembly illustrated herein, which modifications are within the scope of the present invention.

While certain preferred embodiments of the invention have been shown and described, and reference has been made to modifications thereof, it will be apparent to those skilled in the art that various other changes and modifications may be made in the illustrative structures within the spirit and scope of the invention. It is intended that all such changes and modifications be included within the scope of the appended claims.

Having thus described the invention, what I claim as new and desire to secure by Letters Patent is:

1. In combination with adjustable shoring apparatus including a truss-like structure, a vertically extending elongated leg associated with and extending below said structure to provide support therefor, said leg being vertically reciprocally movable relative to said structure for adjusting the combined height thereof, said leg having a vertical series of support pin holes which extend transversely therethrough, and means for adjustably connecting said leg to said structure at a selected vertical position relative thereto including means on the structure defining a support pin hole arranged for registering successively with said support pin holes in the leg, and a support pin removably insertable through said registering support pin holes, a leg brace assembly which comprises:

an elongated leg brace member, means for connecting said leg brace member to said structure for swinging movement of the leg brace member about an axis extending transversely of the structure, and means for detachably connecting said leg brace member to said leg at a point spaced below said structure and spaced above the lower end of said leg to thereby brace the leg against the structure, said latter means including means on the leg brace member defining a connecting pin hole arranged for registering with a selected one of said support pin holes in said leg, and a connecting pin removably insertable through said connecting pin hole and said support pin hole registering therewith, whereby said leg brace member may be disconnected from said leg and swung upwardly about said axis to a position wherein the leg brace member is disposed completely above the bottom surface of the structure to permit movement of the shoring apparatus on said surface without interference from the leg brace member.

2. A combination as defined in claim 1 and wherein said means for connecting said leg brace member to said structure include a pivot pin interposed between the structure and the leg brace member for swinging movement of the leg brace member about the axis of the pin, and adjustment means for varying the disposition of said pivot pin between said structure and said leg brace member for connecting the leg brace member to said leg at points spaced varying distances below the structure.

3. A combination as defined in claim 1 and wherein said means for connecting said leg brace member to said structure include a pivot pin interposed between the structure and the leg brace member for swinging movement of the leg brace member about the axis of the pin, and adjustment means for varying the disposition of said pivot pin between said structure and said leg brace member for connecting the leg brace member to said leg at points spaced varying distances below the structure.

4. In combination with adjustable shoring apparatus including a pair of truss-like structures joined together in spaced parallel relation, a vertically extending elongated leg associated with and extending below each of said structures to provide support therefor, each of said legs being vertically reciprocally movable relative to its associated structure for adjusting the combined height thereof, and means for adjustably connecting each of said legs to its associated structure at a selected vertical position relative thereto, a leg brace assembly which comprises:

a frame extending transversely between said structures, means for connecting said frame to said structures for swinging movement of the frame about an axis extending transversely of the structures, and means for detachably connecting said frame to each of said legs at a point spaced below its associated structure to thereby brace the legs against the structures both laterally and longitudinally thereof, whereby said frame may be disconnected from said legs and swung upwardly about said axis to a position wherein the frame is disposed completely above the bottom surfaces of said structures to permit movement of the shoring apparatus on said surfaces without interference from the frame.

5. A combination as defined in claim 4 and wherein said means for connecting said frame to said structures include a pivot pin interposed between each structure and the frame for said swinging movement of the frame about the axes of the pins, and adjustment means for varying the dispositions of said pivot pins between said frame and said structures for connecting the frame to the legs at points spaced varying distances below the structures.

6. A combination as defined in claim 4 and wherein said legs each have a vertical series of support pin holes which extend transversely therethrough, said means for connecting each leg to its associated structure include means on the structure defining a support pin hole arranged for registering successively with said support pin holes in the leg, and a support pin removably insertable through said registering support pin holes, and said means for connecting said frame to said legs include means on the frame defining a connecting pin hole on each of opposite sides of the frame and arranged for registering with a selected one of said support pin holes in an adjacent leg, and a connecting pin removably insertable through each of said connecting pin holes and said support pin hole registering therewith.

7. A combination as defined in claim 6 and wherein said means for connecting said frame to said structures include a pivot pin interposed between each structure and the frame for said swinging movement of the frame about the axes of the pins, and adjustment means for varying the dispositions of said pivot pins between said frame and said structures for connecting the frame to the legs at points spaced varying distances below the structures.

8. A combination as defined in claim 7 and wherein said frame comprises a pair of spaced apart elongated leg brace members forming the sides of the frame, and a pair of cross brace members extending between and rigidly interconnecting said leg brace members, said leg brace members each have a longitudinal series of pivot pin holes therein adjacent one end of said frame and which comprise said adjustment means, and a connecting pin hole therein adjacent the opposite end of the frame, and said pivot pins are mounted on respective ones of said structures for insertion of each pivot pin in a selected pivot pin hole in a leg brace member for swinging movement of the leg brace members on the pivot pins.

9. An assembly of adjustable shoring apparatus and a leg brace assembly, said shoring apparatus comprising:

upper and lower pairs of spaced apart parallel chords having horizontally extending longitudinal axes, the chords in said lower pair being spaced beneath and vertically aligned with respective chords in said upper pair, a plurality of struts extending obliquely from said upper chord pair to said lower chord pair and between the chords in each pair in a continuous longitudinal series of strut pairs of like substantially V-shaped configuration having their apices at said lower chord pair, the center lines of successive strut pairs being uniformly spaced apart, the chords in said lower pair having pairs of aligned holes in respective chords and centered on said center lines of successive strut pairs, means connecting the upper and lower ends of said struts respectively to the chords of said upper and lower pairs in a truss-like structure adapted for supporting a load on the chords of said upper pair, a plurality of vertically extending elongated legs each having a vertical series of support pin holes which extend transversely therethrough, said legs having upper portions inserted between the chords in said lower pair and lower portions extending below said structure to provide support therefor, and said legs being vertically reciprocally movable relative to said structure for adjusting the combined height thereof, the strut pairs in said series each being adapted for inserting one of said legs between the struts of and at the apex of the strut pair, said legs being inserted between said struts in respective selected strut pairs and being insertable alternatively between the struts of other strut pairs and at other locations along the length of said structure for supporting the structure alternatively at said other locations, said support pin holes in said legs being adapted for registering successively with said pairs of chord holes adjacent to the inserted legs, and means for supporting said structure on said legs adjustably at varying elevations including means carried by the chords in said lower pair and defining support pin holes, said hole-defining means being adapted for disposing the pin holes thereof on opposite sides of each leg for registry with said pairs of chord holes thereat and with said support pin holes of the leg successively in any of said locations of the leg, and a support pin removably insertable through a selected one of said support pin holes in each leg and through the support pin holes of said hole-defining means and said chord holes in registry therewith for transferring the load forces from said hole-defining means to said legs;

and said leg brace assembly comprising:

an elongated leg brace member having a longitudinal series of pivot pin holes therein adjacent to one end thereof and a connecting pin hole therein adjacent to the opposite end thereof, pin mounting means inserted in a pair of said chord holes at a first strut pair which is adjacent to a second strut pair having a leg inserted between the struts thereof, a pivot pin on said pin mounting means and extending transversely with respect to said structure and inserted in a selected one of said pivot pin holes in said leg brace member for swinging movement of the leg brace member thereon, said connecting pin hole in said leg brace member being arranged for registering with a selected one of said support pin holes in the leg inserted at said first strut pair, and a connecting pin removably insertable through said connecting pin hole and said support pin hole registering therewith, whereby the disposition of said pivot pin between said lower chord pair and said leg brace member is variable for connecting the leg brace member to the latter leg at points spaced varying distances below the lower chord pair and spaced above the lower end of the latter leg, and the leg brace member may be disconnected from the leg and swung upwardly on said pivot pin to a position wherein the leg brace member is disposed completely above the bottom surfaces of the lower chord pair to permit movement of the shoring apparatus on said surfaces without interference from the leg brace member.

10. An assembly of shoring apparatus and a leg brace assembly as defined in claim 9 and wherein said leg brace assembly includes a spacer mounted on said leg brace member adjacent to said opposite end thereof for swinging movement between a leg brace member-spacing position interposed between the leg brace member and said last-named leg, and an out-of-the-way position permitting the leg brace member to be swung upwardly without interference of the spacer with the adjacent chord in said lower chord pair.

11. In combination, a pair of assemblies of shoring apparatus and a leg brace assembly as defined in claim 9, in spaced parallel relation, and a pair of cross brace members extending between and interconnecting the leg brace members of said assemblies in a rigid frame which may be swung upwardly about the pivot pins of said assemblies to a position wherein the frame is disposed completely above the bottom surfaces of the lower chord pairs in said assemblies.

* * * * *